US006820521B2

(12) United States Patent
Dobson et al.

(10) Patent No.: US 6,820,521 B2
(45) Date of Patent: Nov. 23, 2004

(54) NUTSETTER

(75) Inventors: Stewart B. Dobson, Janesville, WI (US); Malek Abdul Massih, Valrico, FL (US)

(73) Assignee: Black & Decker Inc., Newark, DE (US)

( * ) Notice: Subject to any disclaimer, the term of this patent is extended or adjusted under 35 U.S.C. 154(b) by 372 days.

(21) Appl. No.: 09/981,975

(22) Filed: Oct. 16, 2001

(65) Prior Publication Data

US 2002/0023521 A1 Feb. 28, 2002

Related U.S. Application Data

(62) Division of application No. 09/246,237, filed on Feb. 8, 1999, now Pat. No. 6,354,175.

(51) Int. Cl.[7] ..... B25B 13/02
(52) U.S. Cl. ..... 81/119; 81/121.1
(58) Field of Search ..... 81/119, 121.1

(56) References Cited

U.S. PATENT DOCUMENTS

| | | | | |
|---|---|---|---|---|
| 3,125,910 A | | 3/1964 | Kavalar | |
| 4,581,957 A | * | 4/1986 | Dossier | 81/121.1 |
| 4,765,211 A | | 8/1988 | Colvin | |
| 4,930,378 A | * | 6/1990 | Colvin | 81/121.1 |
| 5,481,948 A | | 1/1996 | Zerkovitz | |

* cited by examiner

*Primary Examiner*—James G. Smith
(74) *Attorney, Agent, or Firm*—Harness, Dickey & Pierce, P.L.C.

(57) ABSTRACT

A tool for driving headed fasteners has an opening in the tool. The opening is defined by a wall of the tool. The wall has a plurality of flat planar surfaces. The planar surfaces are connected by a connection at the ends of each planar surface to define the opening. Each connection surface has a convex surface continuous with the planar surface. A concave surface is continuous with the convex surface. The convex and concave surfaces define arcs with the arcs having the same radius.

7 Claims, 2 Drawing Sheets

NUTSETTER

This is a divisional of application Ser. No. 09/246,237, filed Feb. 8, 1999, now U.S. Pat. No. 6,354,175.

BACKGROUND AND SUMMARY OF THE INVENTION

The present invention relates to a tool for driving headed fasteners, and more particularly, to a socket type tool or a nutsetter.

When loosening or tightening headed fasteners, it is desirous to remove or tighten the fastener without marring or destroying the head. Generally, fastener heads are six-sided and known in the field as hex heads. When tightening a hex head, it is important to apply a force near but not at the vertices of adjacent flat sides. This prohibits the rounding of the vertices and thus enables the hex head to be easily turned by a nutsetter or the like.

Various tools exist in the art for tightening hex heads. The following United States patents illustrate various designs for accomplishing the tightening or loosening of the hex heads. These United States patents define different surfaces to position around and exert a force on the hex heads. These tools are illustrated by U.S. Pat. Nos. 4,581,957; 5,481,948; 4,882,957; 5,012,706; 5,284,073; 5,131,312; 4,512,220; 5,092,203; 4,930,378; 4,598,616; 4,765,211; 5,219,392; and 5,388,486. While these tools appear to work satisfactorily for their intended purpose, inventors strive to improve the art.

The present invention provides the art with a tool that provides clearance for the vertices of the hex heads. The tool bore, at the intersection of the flat surfaces, reduces stress concentrations and thus reduces the possibility of bursting a female socket. The present invention has a contact surface which provides an enhanced mechanical advantage. The present invention provides a tool with a contact face that exerts equal force in both directions of rotation. The tool also contacts the hex heads away from its vertices to reduce the possibility of rounding the polygonal shape of the hex head.

In accordance with one aspect of the invention, a tool for driving headed fasteners comprises an opening in the tool. The opening is defined by a wall of the tool. The wall has a plurality of planar or flat surfaces which are connected to one another by connecting surfaces at their ends to define the opening. Each connecting surface has a convex surface continuous with the planar surface. Also, a concave surface is continuous with the convex surfaces. The concave and convex surfaces define arcs with the arcs having the same radius. The concave surfaces are symmetric about a central axis of the tool. The convex surfaces intersect the planar surfaces at a tangent point. Also, the convex surfaces intersect the concave surfaces at a tangent point. The convex surface contacts the fastener head such that the contact point is at an angle with respect to a line bisecting the flat surface to the tool center with a line from the contact point to the tool center, the angle being from about nineteen to twenty-three (19°–23°) degrees. Further, the radius of the convex and concave surfaces is proportional to a distance between parallel planar surfaces such that the radius is eight (8%) percent of the distance. Also, the concave surfaces are on a circle with the center at the center of the tool. The circle has a diameter which is about 1.178 times the distance between planar parallel surfaces. The contact surfaces apply equal force to the hex head whether the fastener is loosened or tightened.

From the following detailed description, taken in conjunction with the drawings and subjoined claims, other objects and advantages of the present invention will become apparent to those skilled in the art.

DETAILED DESCRIPTION OF THE PREFERRED EMBODIMENT

Figure 1:
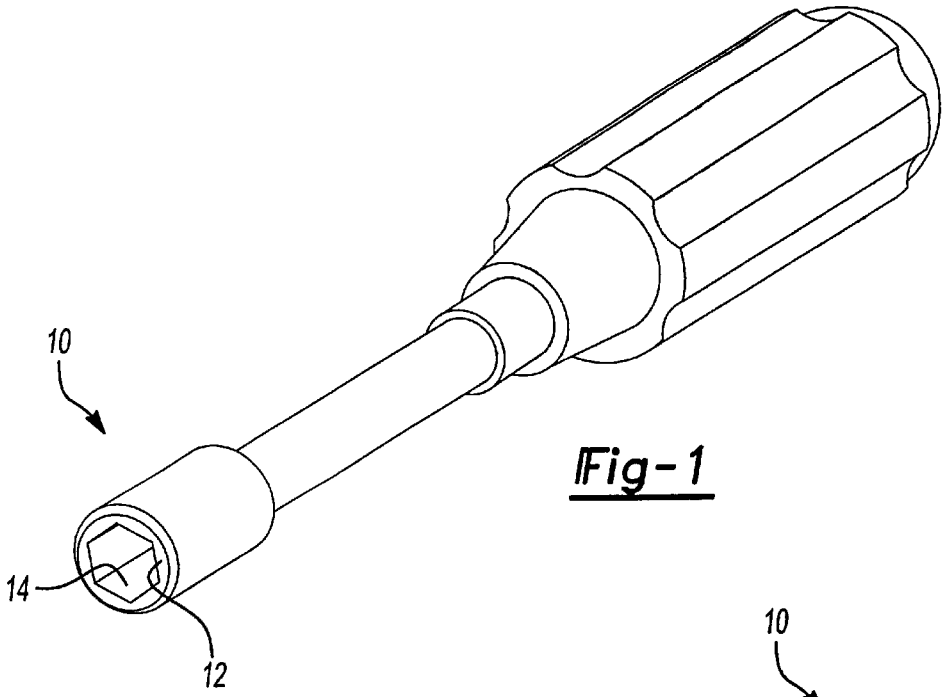
FIG. 1 is a perspective view of a nut driver socket in accordance with the present invention.
Figure 2:
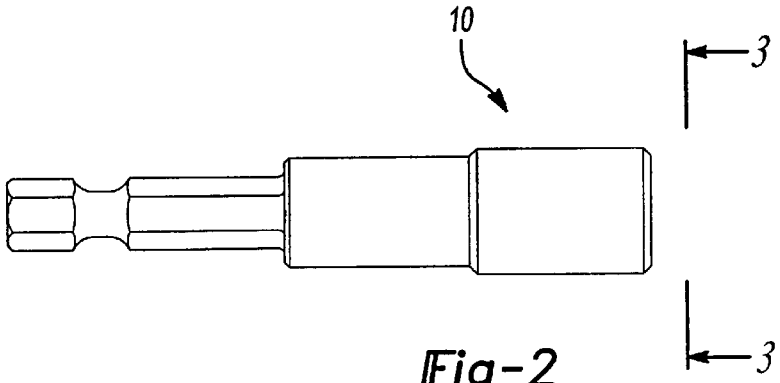
FIG. 2 is a side view of an extension with a socket in accordance with the present invention.
Figure 3:
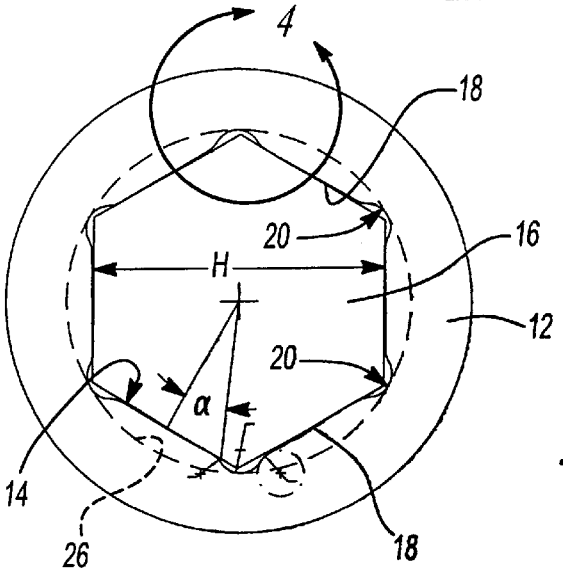
FIG. 3 is a plan view of the socket in the direction of Arrow 3.

Turning to the figures, particularly FIG. 1, a nut driver socket is illustrated and designated with the reference numeral 10. The socket 10 includes a wall 12 which defines a central bore 14. The central bore 14 has a polygonal shape, preferably a hexagon, to receive fastener hex heads 16.

The central bore 14 is defined by a plurality of flat planar surfaces 18 and connecting portions 20. The flat planar surfaces 18 are positioned with respect to one another such that the surfaces which are parallel with respect to one another define a distance H. The distance H defines the head size to which the particular socket fits.

The planar surfaces 18 may run the entire distance through the socket or they may terminate anywhere along the socket.

Figure 4:
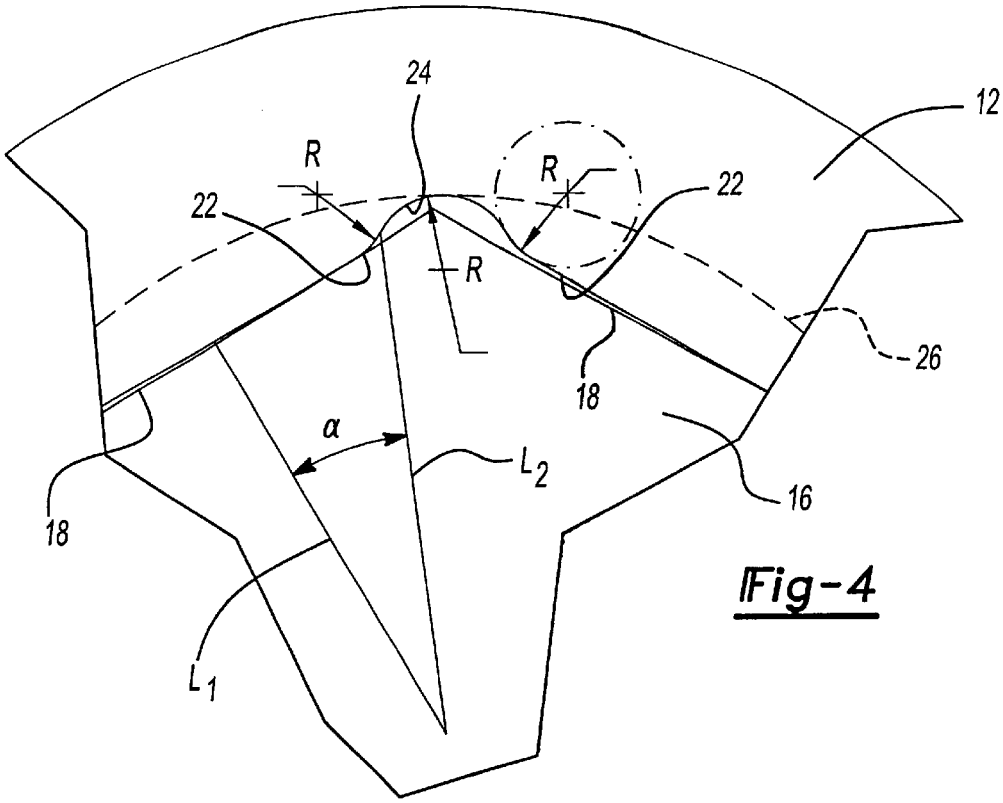
FIG. 4 is a partial enlarged view of FIG. 3 within the circle 4.

The connecting surface 20 is best illustrated in the enlarged view in FIG. 4. The connecting surface 20 includes a convex surface 22 which is continuous with the flat planar surface 18 and a concave surface 24. The concave surface 24 is continuous with the convex surface 18. Thus, at adjoining planar surfaces, each convex surface 22 leads into the concave surface 24. The convex 22 and concave 24 surfaces both define arcs. Each arc is defined by a radius R which, in both the convex and concave surfaces, is the same. The size of the radius is proportional to the distance (H) between the parallel planar surfaces. The proportion is such that the radius is at a ratio of 0.08 H.

The convex surface 22 joins the flat planar surface 18 at a tangent point of the curve of convex surface. Likewise, the concave surface 24 joins the convex surface 22 at a tangent point of the curves of the concave surface. Further, as can be seen from the circle 26 drawn in dot-and-dash, the concave surfaces are along a circle which is centered at the center of the tool. The circle 26 has a diameter which is at a ratio of 1.178 times H. Thus, the outside quadrant is tangent through the circle with the center at the center of the socket.

The point where the tool contacts the hex head is along the convex surface. The contact point is positioned at an angle (∀) with respect to the center of the tool. Taking the line L1 from the midpoint of the flat surface 18 to the center and then striking a line L2 from the midpoint to the contact point such that the angle between L1 and L2 is between nineteen and twenty-three (19°–23°) degrees. This position of the contact point provides increased mechanical advantage in applying the force. Also, equal force is applied to the hex head in both directions of rotation.

Figure 5:
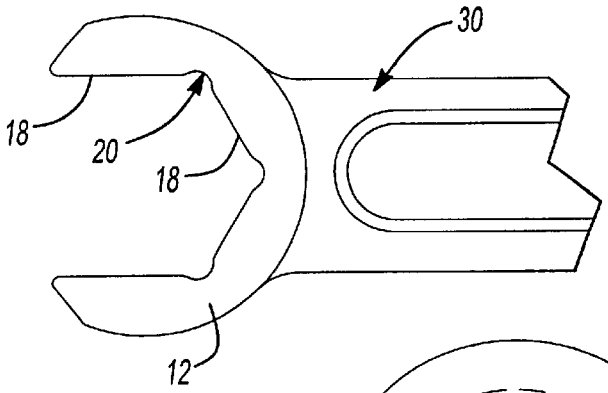
FIG. 5 is a plan view of another embodiment of the present invention.
Figure 6:
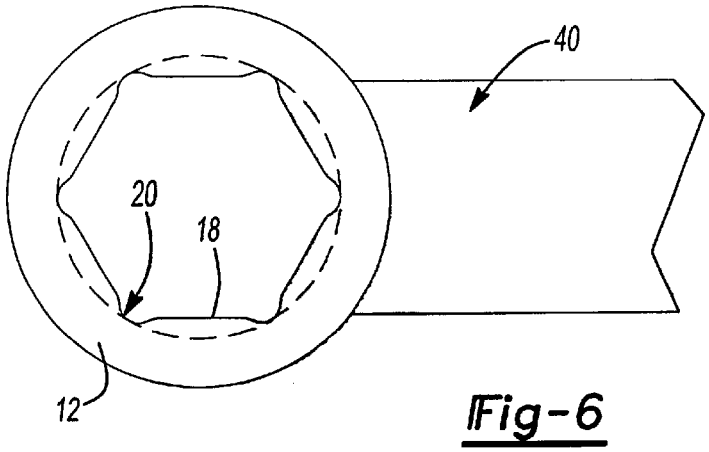
FIG. 6 is a plan view of an additional embodiment of the present invention.

Turning to FIGS. 5 and 6, the invention is illustrated on a closed box end wrench 30 and closed end wrench 40. It is understood that the flat surfaces and connecting portions are the same as those previously described and are identified with the same numerals.

While the above detailed description describes the preferred embodiment of the present invention, the invention is susceptible to modification, variation, and alteration without deviating from the scope and fair meaning of the subjoined claims.

We claim:

1. A tool for driving headed fasteners comprising:

an opening in said tool;

said opening defined by a wall of said tool, said wall having a plurality of planar surfaces, a connection surface connecting said planar surfaces at their ends to define said opening, each said connection surface having a convex surface continuous with said planar surface and a concave surface continuous with said convex surfaces, said concave and convex surfaces define arcs with said arcs having the same radius.

2. The tool according to claim 1, wherein said concave surfaces being symmetrical about a central axis of the tool.

3. The tool according to claim 1, wherein said convex surface intersects said flat surface at a tangent.

4. The tool according to claim 1, wherein said convex surface intersects said concave surface at a tangent.

5. The tool according to claim 1, wherein said concave surfaces are on an imaginary circle with a center at the center of said tool.

6. The tool according to claim 5, wherein said circle has a diameter, said diameter being 1.178 times the distance between opposing parallel planar surfaces.

7. The tool according to claim 1, wherein said convex surfaces apply equal force to a head of the fastener whether said fastener is loosened or tightened.

* * * * *